US007291778B2

(12) United States Patent
Larry

(10) Patent No.: US 7,291,778 B2
(45) Date of Patent: Nov. 6, 2007

(54) NECK SOCK COVER FOR A STRINGED INSTRUMENT

(75) Inventor: John David Larry, 652 Tularosa Dr., Los Angeles, CA (US) 90026

(73) Assignee: John David Larry, Los Angeles, CA (US)

( * ) Notice: Subject to any disclaimer, the term of this patent is extended or adjusted under 35 U.S.C. 154(b) by 0 days.

(21) Appl. No.: 10/749,355

(22) Filed: Dec. 31, 2003

(65) Prior Publication Data

US 2005/0145095 A1 Jul. 7, 2005

(51) Int. Cl.
*G10G 3/00* (2006.01)

(52) U.S. Cl. ..... 84/453

(58) Field of Classification Search ..... 84/290, 84/453, 329; D17/99

See application file for complete search history.

(56) References Cited

U.S. PATENT DOCUMENTS 6,135,277 A * 10/2000 Armstrong ..... 206/314
6,670,536 B2 * 12/2003 Godin et al. ..... 84/453
2002/0092407 A1 * 7/2002 Lin ..... 84/453

* cited by examiner

*Primary Examiner*—Kimberly Lockett
(74) *Attorney, Agent, or Firm*—John David Larry

(57) ABSTRACT

The neck sock cover for stringed instruments is used while the instrument is not being played. It protects the headstock, neck, tuning pegs, and strings of a stringed instrument, such as a guitar, while at the same time allowing the remaining areas of the instrument to be displayed. In one embodiment, the cover comprises a top portion for covering the headstock and tuning keys of said instrument; a body portion for covering the strings of said instrument, with one or more straps to secure the body portion around the headstock; and an end portion for attaching said cover to the body of said instrument. Another embodiment also has one or more detachable straps connected at one end to a free edge of the top portion of said cover and connected at another end to a free edge of the end portion of said cover. Other embodiments additionally have one or more pockets accommodated within said cover or accommodated on the exterior of the cover. The cover can be made of any suitable material such as fabric or plastic.

7 Claims, 1 Drawing Sheet

NECK SOCK COVER FOR A STRINGED INSTRUMENT

CROSS-REFERENCES TO OTHER RELATED PATENT APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND OF THE INVENTION

Stringed instrument cases are known in the art as primarily protecting the instruments against physical damage while they are not being played. These cases come in many forms, such as cases formed from soft and hard materials. One main disadvantage is that musicians are unable to display their instruments when they are stored in these cases. When the instruments are displayed outside of a case, the strings can become tarnished and oxidized in a very short period of time. Strings on instruments are adversely affected by moisture in the air and other atmospheric conditions which can also cause rust and corrosion which in turn leads to the deterioration of the instrument's tone quality.

Similarly, stringed instrument covers are known in the art primarily to cover the sound box portion of the instrument for use when the instrument is being played. For example, U.S. Pat. No. 3,877,501, issued to John Toth, discloses a protective cover for a violin that is designed to protect the portion of the sound box that comes into contact with parts of the body when the instrument is being played.

There is a need for a stringed instrument cover that allows the instrument's strings, neck and headstock to be protected while at the same time allowing the visually pleasing areas of the instrument to be displayed.

BRIEF SUMMARY OF THE INVENTION

The neck sock cover for stringed instruments is used while the instrument is not being played. It protects the headstock, neck (including top, side and back surface portions,) tuning pegs, and the entire length of the strings of a stringed instrument, such as a guitar, while at the same time allowing the remaining areas of the instrument to be displayed.

In particular, one embodiment of the present cover comprises a top portion for covering the headstock, including the tuning keys, of said instrument; a body portion for covering the strings and top portion of the neck of said instrument with one or more straps to secure the body portion around the neck; and an end portion for attaching said cover to the body of said instrument. Another embodiment also has one or more detachable straps connected at one end to a free edge of the top portion of said cover and connected at another end to a free edge of the end portion of said cover. Other embodiments have one or more pockets accommodated within said cover or on the exterior of said cover. The cover can be made of any suitable material such as fabric or plastic.

BRIEF DESCRIPTION OF THE SEVERAL VIEWS OF THE DRAWINGS

The above and other objects, advantages and features of the present invention will be more readily apparent from the following description, when read in conjunction with the accompanying drawings wherein.

DETAILED DESCRIPTION OF THE INVENTION

The neck sock cover is generally made of materials such as cotton, felt, denim, fur, vinyl, plastic, duvetyn, mesh, quilted fabric, padded fabric, leather, velvet, or the like. In addition to fabrics of any design, pattern or fiber, some examples of fabrics that can be used are embroidered fabrics and custom imprinted fabrics for promotional use. Preferred materials are soft and pliable, but more rigid materials may also be used. Other materials which can be used include gortex, neoprene, and polypropylene or other similar materials. Materials that can be advantageous to instruments include materials which serve to help keep moisture off the strings while letting the instrument breath and materials that allow moisture escape from the instrument while at the same time keeping moisture from accumulating next to the instrument.

The invention is designed to be attached so as to be fitted over the headstock, including tuning keys or pegs, strings, and neck portions of an instrument. For example, when used with an acoustic or electric guitar, it can be slipped onto the top of the headstock, draped over the strings and neck, and attached with an elastic strap to the bottom of the guitar's sound box or anywhere suitable on the instrument's body. Other examples of several stringed instruments with which the present invention can be used are basses, mandolins, banjos, violins, violas, cellos, double basses, and upright basses. Embodiments of the present invention can be use with all stringed instruments of any shape or size, acoustic or electric.

The neck sock is constructed to allow the strings, surface portion of the neck and headstock, including the tuning pegs/keys, of a guitar to be protected while the majority of the guitar's body, which is not covered by the neck sock cover, can be displayed, seen and appreciated. The guitar with attached neck sock cover can be placed on a guitar stand or mounted into a wall display where the strings, headstock and the neck's top surface are protected where the instrument can be viewed and protected at the same time.

Figure 1:
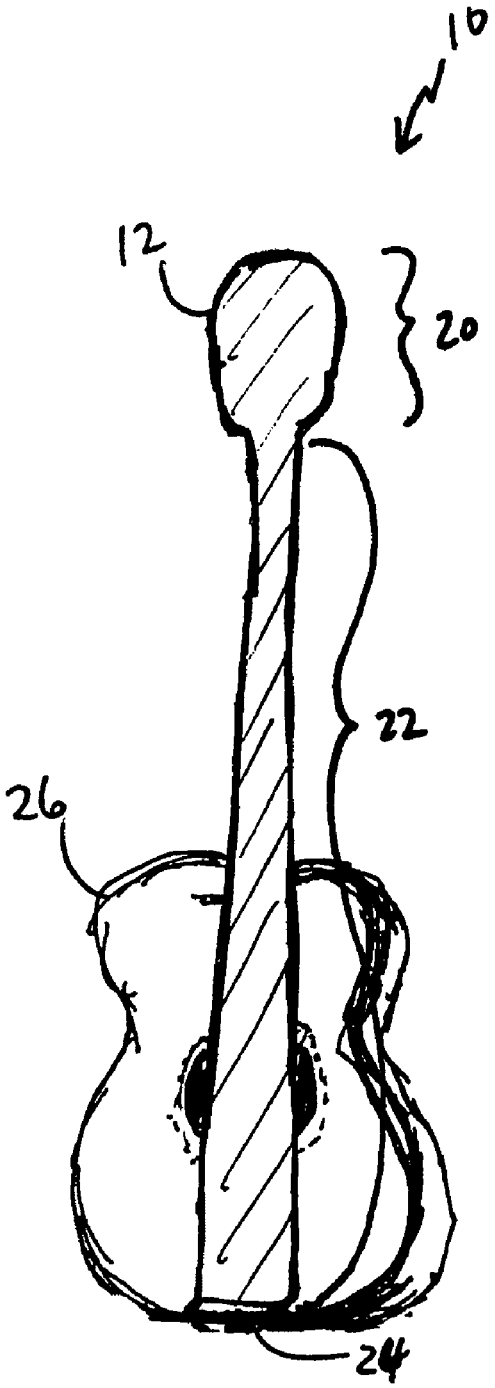
FIG. 1 is a front elevation view of the neck sock cover used in accordance with an embodiment of the invention.

With reference to the drawings, in specific drawing FIG. 1, guitar 10 is shown with a neck sock cover 12 of the present invention. The top portion 20 of the neck sock cover 12 covers headstock (not shown) which includes the tuning keys, which are covered and not shown. The body portion 22 of the neck sock cover 12 lays on top of the strings (also covered and not shown) and on the surface of the guitar neck's top, sides and bottom (not shown.) The end portion of cover 12 is an attachment to the sound box 26 of guitar 10.

Figure 2:
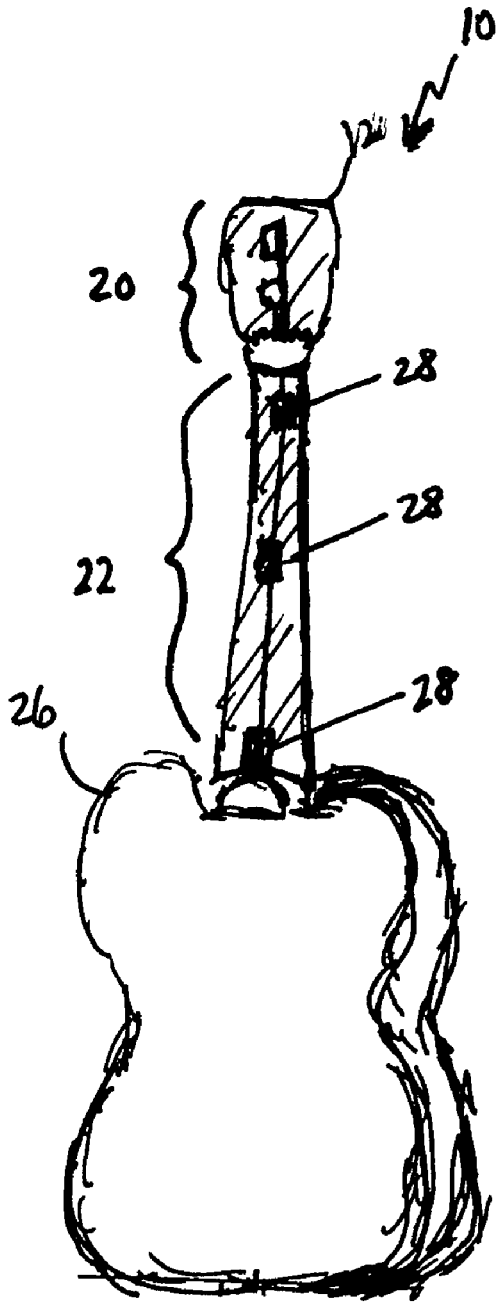
FIG. 2 is a back elevation view of the neck sock cover used in accordance with an embodiment of the invention.

To install the cover 12 onto guitar 10, a cover 12 is first slipped over the headstock, enclosing the headstock and tuning keys with the cover 12. The body portion 22 is laid across the length of the strings and neck top surface and is wrapped around the remainder of the neck where it is secured. The end portion 24 is attached to sound box 26 and the attachment can be a strap made from elastic, VELCRO® or fabric with hook and loop as a means to secure the strap. With reference the drawing FIG. 2, three straps 28 are wrapped around the back of the guitar neck and each strap 28 is secured with elastic, VELCRO®, hook and loop or the like.

A neck sock cover 12 of the present invention can also have one or more detachable straps (not shown) that can be used for carrying the guitar 10 and neck sock cover 12. These straps are preferably attached at one end of the cover 12 to a free edge of the top portion 20 of said cover and connected at another end to a free edge of the body portion 22 or end portion 24.

Different configurations of the top portion 20 can be used to cover various types of guitar headstocks styles, such as the Stratocaster, telecaster, pointed, acoustic les paul, and adjustable short scale styles. The neck cock cover can also have one or more pockets (not shown) accommodated within said cover or disposed on the surface of the cover.

While the present invention has been illustrated and described by means of specific embodiments and alternatives, it is to be understood that numerous changes and modifications can be made without departing from the spirit and scope of the invention. Therefore, it should be understood that the invention is not to be limited in any way except in accordance with the appended claims and their equivalents.

What is claimed is:

1. A cover for a stringed instrument comprising:

a top portion for covering the headstock and tuning keys of said instrument;

a body portion for covering the strings and neck of said instrument with one or more straps to secure the body portion around the headstock; and an end portion for attaching said cover to the body of said instrument;

wherein said end portion is configured so that the exterior surface of the body of said instrument is uncovered thereby permitting a user to view the uncovered body of said instrument.

2. A cover of claim 1 further comprising one or more detachable straps connected at one end to a free edge of the top portion of said cover and connected at another end to a free edge of the end portion of said cover.

3. A cover of claim 1 further comprising one or more pockets accommodated within said cover or on the exterior of said cover.

4. A cover of claim 1 wherein said cover is made of a fabric material.

5. A cover of claim 1 wherein said cover is made of a plastic.

6. A cover of claim 5 wherein said plastic material is clear.

7. A cover of claim 1 wherein said end portion is configured so that a majority of the exterior surface of the body of said instrument is uncovered thereby permitting a user to view the uncovered exterior surface of the body of said instrument.

* * * * *